US005601449A

United States Patent [19]

Shinji et al.

[11] Patent Number: 5,601,449

[45] Date of Patent: Feb. 11, 1997

[54] REAR HOLDER COVER OF WATERPROOF CONNECTOR

[75] Inventors: Yasuhisa Shinji; Hiraji Takase, both of Shizuoka, Japan

[73] Assignee: Yazaki Corporation, Tokyo, Japan

[21] Appl. No.: 329,645

[22] Filed: Oct. 25, 1994

[30] Foreign Application Priority Data

Oct. 25, 1993 [JP] Japan ..... 5-287230

[51] Int. Cl.[6] ..... H01R 13/56

[52] U.S. Cl. ..... 439/447; 439/752; 439/596

[58] Field of Search ..... 439/596, 597, 439/750, 752, 751, 445, 447, 448, 686, 687

[56] References Cited

U.S. PATENT DOCUMENTS

| | | | |
|---|---|---|---|
| 3,399,373 | 8/1968 | Maki et al. | 439/596 |
| 4,660,914 | 4/1987 | Nakamura | 439/596 |
| 4,861,278 | 8/1989 | McBride et al. | 439/596 |
| 4,979,913 | 12/1990 | Aiello et al. | 439/597 |

*Primary Examiner*—Hien Vu

*Attorney, Agent, or Firm*—Sughrue, Mion, Zinn, Macpeak & Seas

[57] ABSTRACT

A rear holder cover of a waterproof connector is provided which remains secured to a connector housing despite being subjected to substantial external forces. The rear holder cover contains a rear cover which is inserted in a connector housing and a plurality of hinge connection portions each having a first end and a second end. The first end of each of the plurality of hinge connection portions is connected to the rear holder, and the second end of each of the plurality of hinge connection portions is connected to a plurality of half covers. The plurality of hinge connection portions are flexible such that the plurality of half covers are pivotally movable in a direction perpendicular to a direction of insertion of the rear holder into the connector housing. Furthermore, each of the plurality of half covers comprises a projection portion and a projection receiving portion. The projection portion of each of the plurality of half covers respectively engages the projection receiving portion of each adjacent half cover so as to secure the rear holder cover on the connector housing. Therefore, the rear holder cover remains secured to the connector housing even if hinges connecting the rear holder to the half covers break and if external forces act on the plurality of half covers and the rear holder.

16 Claims, 4 Drawing Sheets

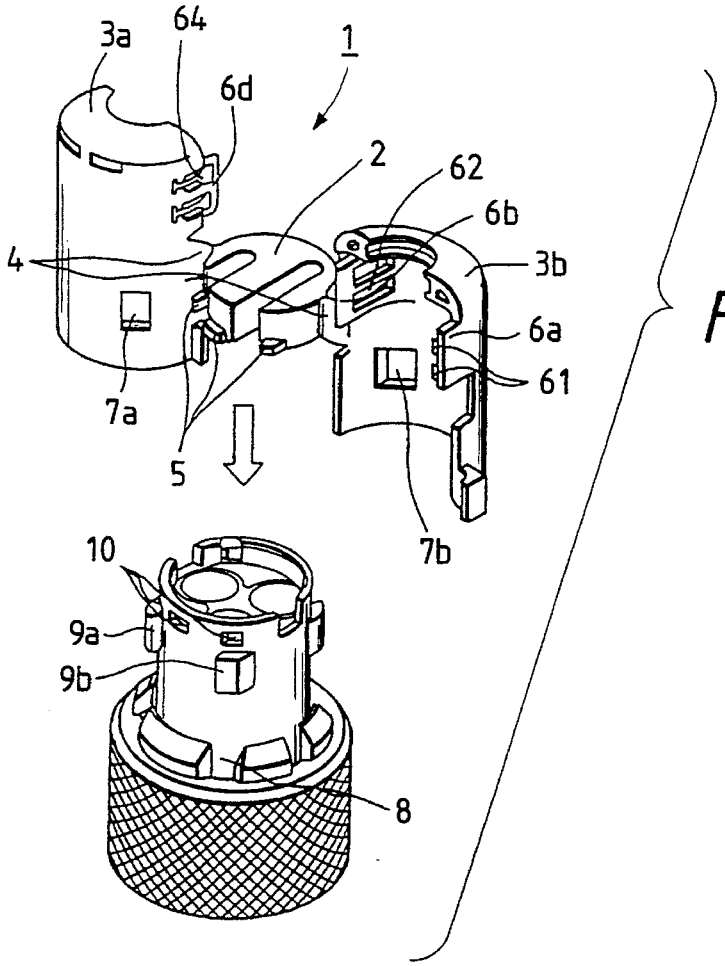
FIG. 1
FIG. 2
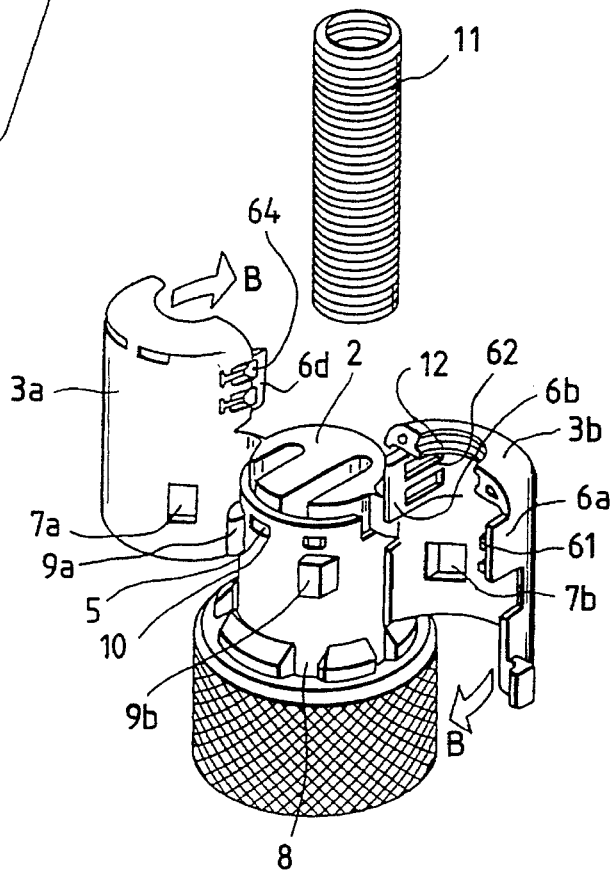

FIG. 8
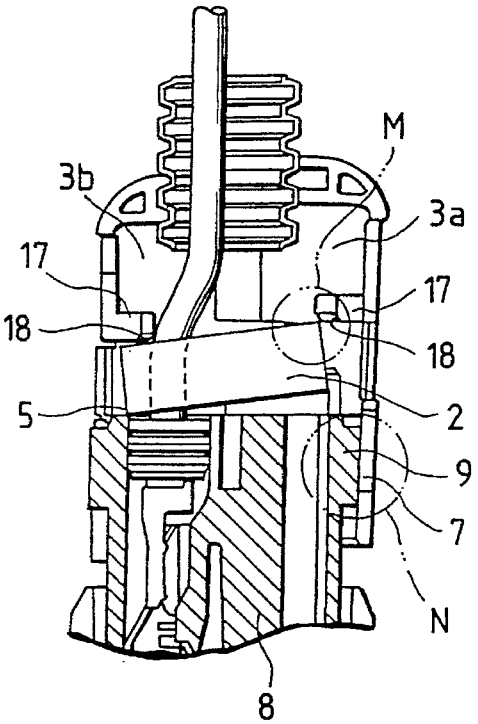
FIG. 9
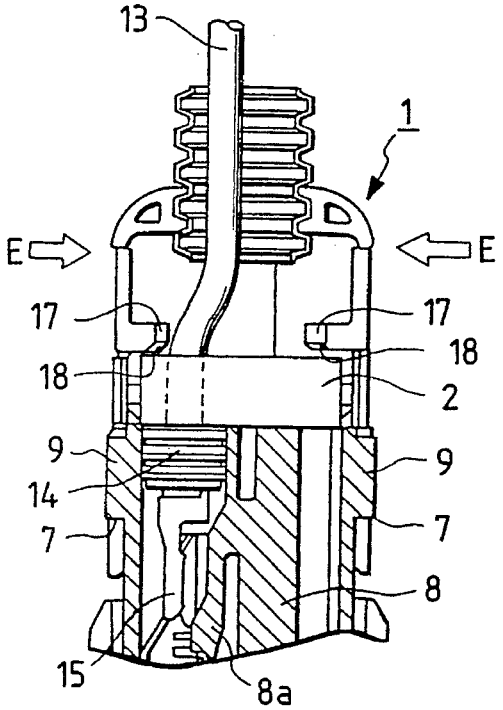
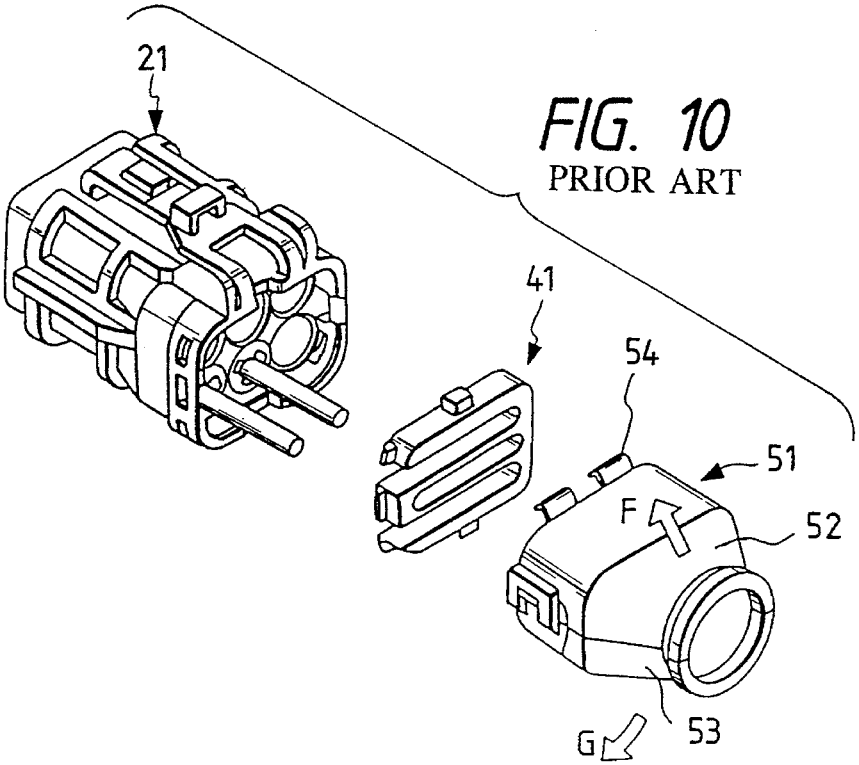
FIG. 10
PRIOR ART

REAR HOLDER COVER OF WATERPROOF CONNECTOR

BACKGROUND OF THE INVENTION

This invention relates to a rear holder cover of a waterproof connector. More, particularly, this invention relates to a rear holder cover of a waterproof connector which contains connection terminals used in electric wiring of an automobile or the like.

In a connector for an automobile, the connector contains a plurality of connection terminals each having a wire connected thereto. In order to prevent the connection terminals from separating from the respective terminal receiving chambers, a rear holder is fitted at a rear end portion of a connector housing.

In such a connector, a problem may arise while washing the automobile with high-pressure water. More specifically, if high-pressure water impinges on the connector and is applied directly to wires around the connector and the rear holder, the rear holder may be displaced and become disengaged. Similarly, if the high-pressure water is applied to a rubber plug of the connector, the rubber plug may be deformed. Consequently, the water may leak into the connector and ruin the electrical connection. Therefore, in order to protect the rear holder and the rubber plug against the high-pressure water stream and other dynamic impacts, it is a common practice to attach a rear holder cover to the connector.

A conventional rear holder cover is separate from a connector housing and is integrally connected to the rear holder. FIG. 10 is an illustration of a waterproof connector as disclosed in Japanese Utility Model Unexamined Publication No. 3-2570. The waterproof connector comprises a connector housing 21 which contains connection terminals, a water plug, a rear holder 41, and a waterproof cover (rear holder cover) 51. The waterproof cover 51 covers a rear end face of the rear holder 41 and can open relative to the rear holder 41 in directions of arrows F and G. In addition, the rear holder 41 comprises a plate-like block and is fixedly fitted in the connector housing 21.

The waterproof cover 51 comprises a pair of lids 52 and 53 which are connected respectively to upper and lower surfaces of the rear holder 41 by elastic straps 54, and the two lids 52 and 53 cover the rear face of the rear holder 41. The straps 54 of the lid 52 are connected to an upper end of the inner face of the rear holder 41, and the lid 52 can be opened upward about this upper end in the direction of the arrow F. The straps (not shown) of the lid 53 are connected to a lower end of the inner face of the rear holder 41, and the lid 53 can be opened downward about this lower end in the direction of the arrow G.

In another known conventional construction, a waterproof cover comprises a pair of upper and lower cover members which are each connected at one end to a rear holder by a hinge. The hinges are provided at one end of the waterproof cover, and each of these cover members is pivotally moved about the hinge for opening and closing purposes.

In the conventional waterproof covers, the straps may become disconnected or the hinges may break due to impacts which may occur during the assembly of the waterproof cover or for many other reasons. If such an impact occurs, the connection between the rear holder and the waterproof cover is broken, and the waterproof cover is unable to prevent water from disrupting the electrical connection.

Furthermore, when an external force is applied to the waterproof cover in a direction perpendicular to the axis of the waterproof cover, the rear holder experiences a significant amount of torque. Consequently, the waterproof cover may be tilted, and the rear holder may also be tilted and may disengage from the connector housing.

SUMMARY OF THE INVENTION

The present invention has been made in order to overcome the above problems inherent in conventional waterproof covers. In order to solve these and other problems, the present invention provides a rear holder cover of a waterproof connector comprising: a rear holder; a plurality of hinge connection portions each having a first end and a second end, wherein the first end of each of the plurality of hinge connection portions is connected to the rear holder, wherein the rear holder is insertable in a connector housing, and wherein the hinge connection portions are pivotally movable in a direction perpendicular to a direction of insertion of the rear holder into the connector housing; and a plurality of half covers respectively connected to the second end of each of the plurality of hinge connection portions, wherein each of the plurality of half covers comprises a projection portion and a projection receiving portion, wherein the projection portion of each of the plurality of half covers respectively engages the projection receiving portion of each adjacent half cover so as to secure the rear holder cover on said connector housing.

In addition, the projection portion may be formed on a first side edge of each of the plurality of half covers and the projection receiving portion may be formed on a second side edge of each of the plurality of half covers and wherein the first side edge and the second side edge are opposite side edges of each of the plurality of half covers and the first side edge and the second side edge are parallel to the direction of insertion of the rear cover.

Also, at least one of the plurality of half covers may comprise an extension portion which extends from a position where the hinge connection portion is connected to the rear holder and which extends in the direction of insertion of the rear holder.

Furthermore, a rib may be formed on an inner surface of at least one of the plurality of half covers and may project in a direction perpendicular to the direction of insertion of the rear holder. Moreover, the rib may comprise a beveled edge portion which contacts the rear holder when the rear holder is improperly inserted in the connector housing and may move the rear holder so as to properly insert the rear holder into the connector housing when at least one of said plurality of half covers closes around the connector housing.

The rear holder cover may further comprise at least one fixing hole which is formed in at least one of the plurality of half covers and at least one fixing projection which is formed on an outer tube of the connector housing. At least the one fixing projection engages at least the one fixing hole when at least one of the plurality of half covers is closed around the connector housing in order to further secure the rear holder cover on the connector housing.

An object of the present invention is to provide a rear holder cover of a waterproof connector which can remain secured to a connector housing even if hinges connecting a rear holder to the rear holder cover break and if external forces act on the rear holder cover and the rear holder. This an other objects and advantages are provided by the present invention for a rear holder cover. Furthermore, the present invention and its advantages will be better understood with reference to the following detailed descriptions and the accompanying drawings.

BRIEF DESCRIPTION OF THE DRAWINGS

FIG. 1 is an exploded perspective view of a first embodiment of rear holder cover of the present invention;

FIG. 2 is a perspective view showing the attachment of the rear holder cover of FIG. 1;

FIG. 8 is a cross-sectional view showing the process of attaching the rear holder cover of FIG. 7;

FIG. 9 is a cross-sectional view showing the rear holder cover of FIG. 7 after it has been attached; and FIG. 10 is a perspective view of a conventional waterproof connector.

DESCRIPTION OF THE PREFERRED EMBODIMENTS

Figure 3:
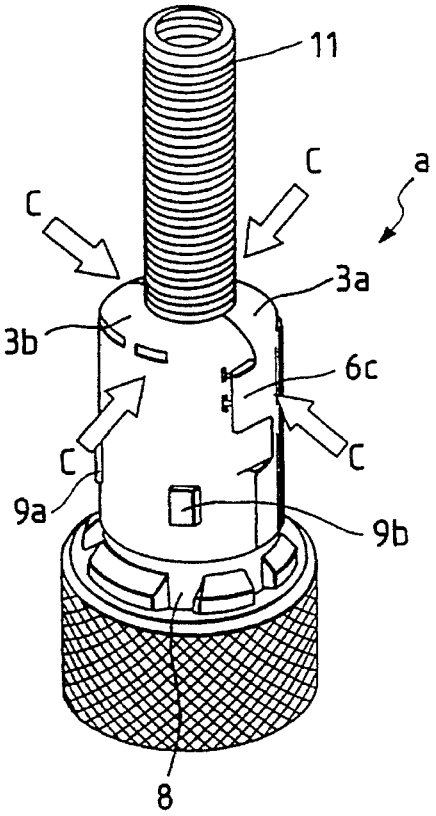
FIG. 3 is a perspective view showing the rear holder cover of FIG. 1 after it has been attached.

FIGS. 1 to 4 show a first embodiment of a rear holder cover of the present invention. As shown in FIGS. 1 and 2, the rear holder cover 1 is integrally molded in a manner such that half covers 3*a* and 3*b* are connected to a rear holder 2 by hinge connection portions (hereinafter referred to as "hinges") 4. The rear holder cover 1 covers a housing 8 and moves in a longitudinal direction of the housing 8 to fit thereon.

Retaining projections 5 are formed on an outer surface of the rear holder 2 in order to respectively engage retaining holes 10 formed in an outer tube of the housing 8. Fixing holes 7*a* and 7*b* are formed through each of the half covers 3*a* and 3*b* in order to respectively engage fixing projections 9*a* and 9*b* formed on the outer tube of the housing 8.

The half cover 3*b* has a cover retaining projection 6*a* and a cover retaining projection-receiving portion 6*b* for retaining the half cover 3*a*. Similarly, the half cover 3*a* has a cover retaining projection 6*c* (FIG. 3) and a cover retaining projection-receiving portion 6*d* for retaining the half cover 3b.

The half covers 3*a* and 3*b* are symmetrical in shape, and the curvature and dimensions of inner surfaces of the half covers 3*a* and 3*b* substantially conform to the shape of the housing 8 when the covers 3*a* and 3*b* are joined together. Although two half covers 3*a* and 3*b* have been described with respect to the present embodiment, the number of half covers are not limited to two, and any number of half covers can be used depending on the dimension, shape, and a material of the housing 8.

The rear holder 2 and the half covers 3*a* and 3*b* are connected together by the plurality of hinges 4. One end of each of the plurality of hinges 4 is connected to a side surface of the rear holder 2, and the other end of the hinges 4 are respectively connected to an inner wall portion of the half covers 3*a* and 3*b*. Also, each hinge 4 is made of a flexible material so that the half covers 3*a* and 3*b* are pivotally movable in the direction perpendicular to the direction of insertion of the rear holder 2 into the housing 8.

Next, the attachment of the rear holder cover 1 to the housing 8 will now be described with reference to FIG. 2. First, the rear holder 2 is fitted in the housing 8, and the retaining projections 5 of the rear holder 2 respectively engage the retaining holes 10 in the housing 8. As a result, the rear holder 2 secures the connection terminals (not shown) within the housing 8.

Then, the half covers 3*a* and 3*b* are pivotally moved in respective directions of the arrows B. Protuberances 61 of the cover retaining projection 6*a* of the half cover 3*b* respectively engage recesses 64 in the cover retaining projection-receiving portion 6*d* of the half cover 3*a*. Similarly, protuberances (not shown) of the cover retaining projection 6*c* of the half cover 3*a* respectively engage recesses 62 in the cover retaining projection-receiving portion 6*b* of the half cover 3*b*. As a result, the half covers 3*a* and 3*b* are securely joined together.

At the same time, the fixing holes 7*a* and 7*b* in the half covers 3*a* and 3*b* are respectively fitted over the fixing projections 9*a* and 9*b* of the housing 8. For example, in FIG. 2, the fixing hole 7*b* in the half cover 3*b* is fitted on the fixing projection 9*b* of the housing 8.

As the half covers 3*a* and 3*b* are fitted around the housing 8, a corrugated tube 11 containing wires 13 is fixedly secured in a fixing groove 12. As a result, the rear holder cover 1 is completely fitted on the housing 8 as shown in FIG. 3.

Furthermore, if a hinge 4 breaks after the half covers 3*a* and 3*b* are joined together, the cover retaining projections 6*a* and 6*c* remain engaged with the cover retaining projection-receiving portions 6*d* and 6*b*, respectively. Also, since the fixing projections 9*a* and 9*b* of the housing 8 respectively engage the fixing holes 7*a* and 7*b*, the rear holder cover 1 is further secured on the housing 8. Therefore, the rear cover 2 remains secured to the housing 8 even if a hinge 4 breaks.

Figure 4:
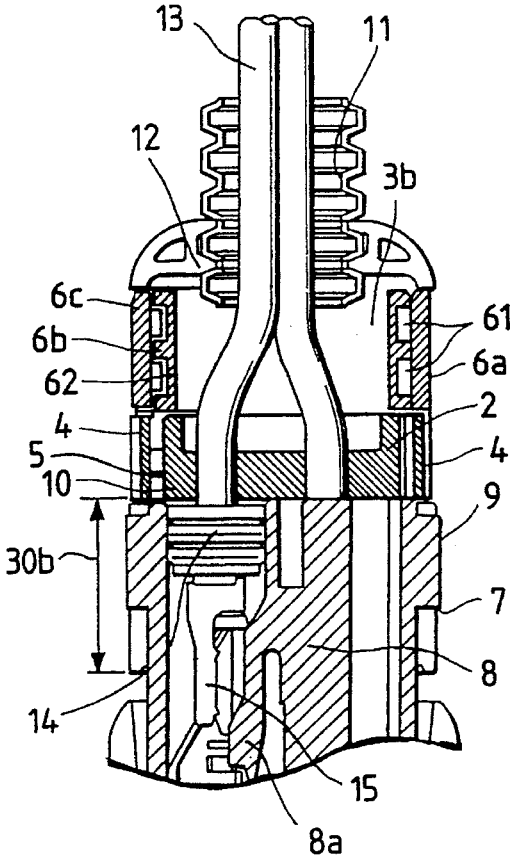
FIG. 4 is a cross-sectional view of the attached rear holder cover.

FIG. 4 is a cross-sectional view of the attached rear holder cover 1. As shown in FIG. 4, the half cover 3*b* can have an extension portion 30*b* to which the hinge 4 is connected. The extension portion 30*b* extends from the inner wall portion of the half cover 3*b* in the direction of insertion of the rear holder 2 into the housing 8. In addition to the extension portion 30*b*, an extension portion extending in a direction opposite to the direction of insertion of the rear holder 2 may also be provided.

As a result of the extension portion 30*b*, if external forces indicated by arrows C (FIG. 3) act on the half covers 3*a* and 3*b*, a resultant torque will not disengage the rear portion 2 since the extension portion 30*b* supports a substantial portion of the outer tube of the housing 8. Therefore, the rear holder 2 in the housing 8 will not be tilted by the external forces and will remain stably secured to the housing 8.

As described above, in order to resist the torque produced by external forces, it is effective to provide the extension portion 30*b* extending in the direction of insertion of the rear holder 2. However, because of the formation of the corrugated tube fixing groove 12 and other factors, it is often necessary to provide another extension portion which extends in the direction opposite to the direction of insertion of the rear holder 2 and which has a length equal to the extension portion 30*b*. However, this construction is not always necessary, and the ratio between the lengths of the two extension portions may be 3 to 7, or 4 to 6. In other words, it is only necessary that the extension portion 30*b* has a sufficient length to resist the bending moment produced by the above external force.

Figure 5:
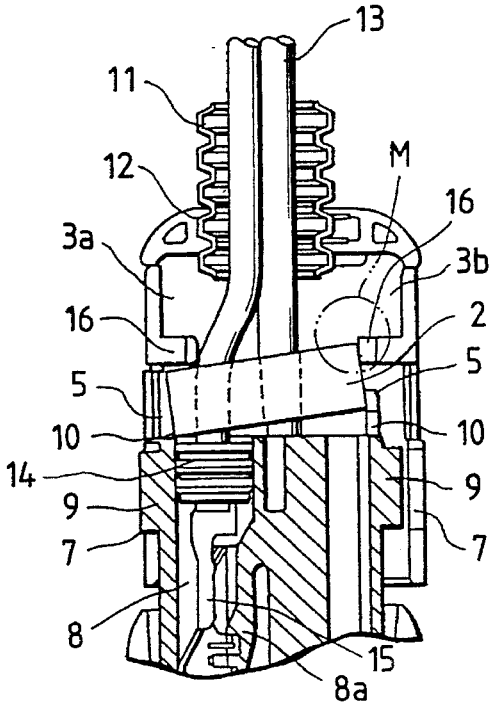
FIG. 5 is a cross-sectional view of a second embodiment of an attached rear holder cover of the present invention.
Figure 6:
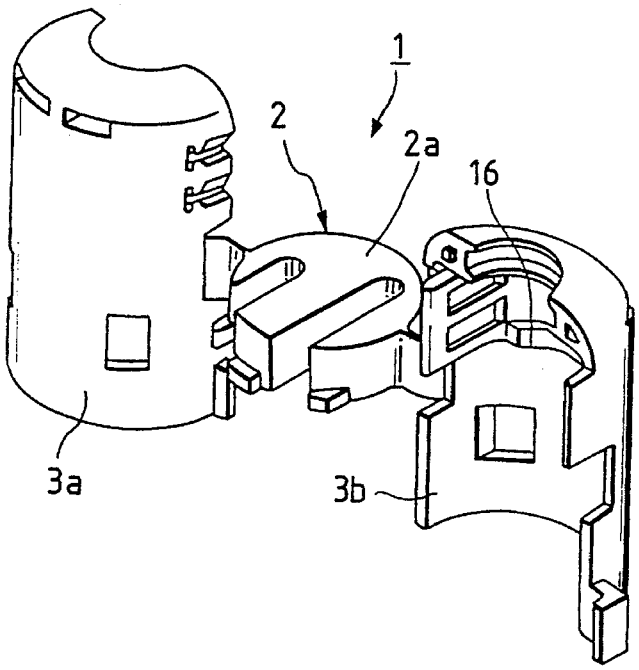
FIG. 6 is a perspective view of the rear holder cover of FIG. 5.

FIGS. 5 and 6 illustrate a second embodiment of a rear holder cover of the present invention. As shown in FIGS. 5 and 6, a rib 16 is formed on an inner surface of each of the half covers 3*a* and 3*b* of the rear holder 1. The rib 16 is constructed such that when the rear holder 2 is completely inserted and fitted in a connector housing 8, the rib 16 is disposed at an outer end face 2*a* of the rear holder 2 and is projected in a direction perpendicular to the direction of insertion of the rear holder 2. Also, if the rear holder 2 is not properly inserted in the connector housing 8, the rib 16 engages the rear holder 2 as indicated by the circle M in FIG. 5. Consequently, the half cover 3*b* cannot close properly and the rear holder cover 1 cannot properly fit around the housing 8. As a result, one can easily detect a faulty insertion of the rear holder 2 and can make necessary corrections. This prevents the shipment of products with rear holders that are improperly inserted, and the percentage of the defective products is reduced.

Figure 7:
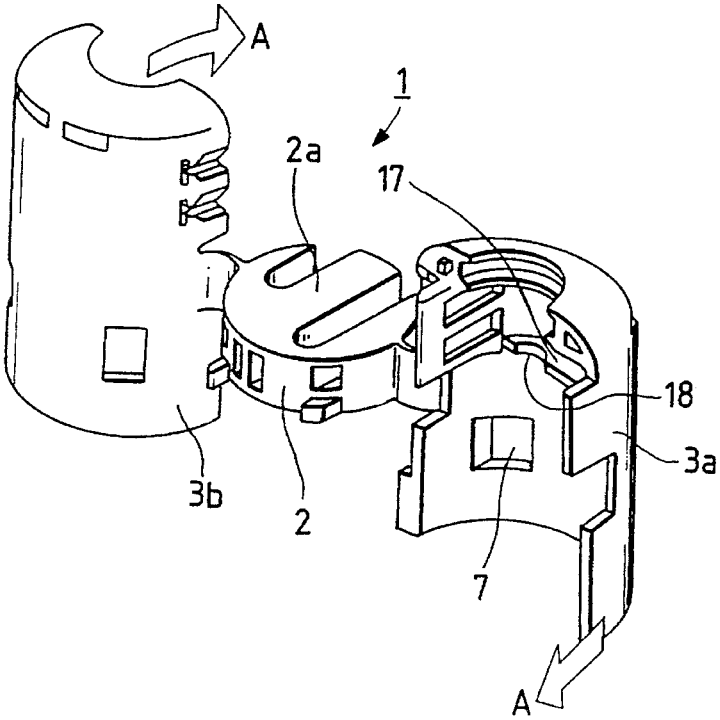
FIG. 7 is a perspective view of a third embodiment of a rear holder cover of the present invention.

FIGS. 7 through 9 are illustrations of a third embodiment of a rear holder cover 1 of the present invention. As shown in FIGS. 7 through 9, a rib 17 is formed on an inner surface of each of the half covers 3*a* and 3*b* of the rear holder cover 1. The rib 17 is constructed such that when the rear holder 2 is completely inserted and fitted in a connector housing 8, the rib 17 is disposed at an outer end face 2*a* of the rear holder 2 and is projected in a direction perpendicular to the direction of insertion of the rear holder 2.

Also, each rib 17 has a beveled edge portion 18 that contacts the outer end face 2*a* of the rear holder 2. If the rear holder 2 is not properly inserted in the connector housing 8, the rib 17 contacts the rear holder 2 when the half covers 3*a* and 3*b* are closed around the housing 8 as indicated by the circle M in FIG. 8. At this time, an inclined surface of the beveled edge portion 18 at the lower side of the rib 17 contacts the raised rear holder 2. When the pivoting of the half cover 3*a* proceeds, the inclined surface of the beveled edge portion 18 urges the rear holder 2 down toward the housing 8.

After the half cover 3*a* has completely pivoted into position around the housing 8, the rear holder 2 has been forced into the housing 8 and properly inserted into position. As a result, it is not necessary to ensure that the rear holder 2 is properly inserted before securing the rear holder cover 1 around the housing 8. Therefore, even if the rear holder 2 is improperly inserted, there is no need for any correction, and the efficiency of the assembly of the rear holder cover 1 is greatly improved.

In the second and third embodiments, the ribs 16 and 17 may be relatively thick. In such a case, the rear holder cover 1 itself is further reinforced to have an increased strength with which to withstand external forces acting in directions of the arrows E (FIG. 9).

Also, as shown in FIG. 9, after rear holder cover 1 is secured around the housing 8, the lower surface of the rib 17 (and rib 16 of the second embodiment) urges the upper end face 2*a* of the rear holder 2 downward and/or abuts against the upper end face 2*a* of the rear holder 2. Consequently, the ribs 16 and 17 prevent the rear holder 2 from moving upward and prevent the rear holder 2 from becoming disengaged.

As shown in FIG. 9, each connection terminal 15 is contained in the housing 8 and is secured by a lance 8*a* formed in the housing 8. A rubber plug 14 is sealingly mounted on a proximal end portion of the terminal 15, and the rear holder 2 is inserted such that it holds the rubber plug 14 from the outer side. Since the ribs 16 and 17 hold the inserted rear holder 2 in position, the ribs 16 and 17 indirectly secure the rubber plug 14 and prevent the rubber plug 14 from becoming disengaged or displaced from the housing 8.

As described above, the present invention has the advantages of efficiently fixing the electrical connection terminals, fixing the rubber plugs, covering the members mounted on the housing, and withstanding an impact of external forces. As a result, the present invention satisfies a substantial need of the industry.

In the rear holder cover of the present invention, the plurality of hinge connection portions are provided on the plate-like rear holder to be inserted into the connector housing and are pivotally movable in the direction perpendicular to the direction of insertion. The plurality of half covers are respectively connected to the other ends of the hinge connection portions so that they can pivot towards each other around the housing. When the side edges of each half cover pivot and are respectively brought into contact with the side edges of the adjacent half cover, each cover retaining projection provided at each side edge engages the corresponding cover retaining projection-receiving portion. CoNsequently, the half covers are able to securely hold themselves together. Therefore, even if the hinge connection portion breaks, the half cover can still securely cover the connector housing. As a result, the rear cover will not become disengaged if the hinge connection portion breaks.

Moreover, the extension portion extends parallel to the direction of insertion of the rear holder from the position where the hinge connection portion is provided. Consequently, the extension portion engages and covers the connector housing over a relatively long distance and substantially supports the half cover. Therefore, even if an external force acts on the connector housing, the rear cover will not become tilted and disengage.

Furthermore, the rib is formed on the inner surface of the half cover and projects in the direction perpendicular to the direction of insertion of the rear holder. Thus, if the rear holder is not properly inserted into the connector housing, the rib contacts the rear holder during the pivoting of the half cover and prevents the half cover from completely closing. With this construction, an improper insertion of the rear holder can easily be detected and can be corrected. Thus, the percentage of defective products is reduced.

If the rib has a beveled edge portion and the rear holder is improperly inserted in the housing, the beveled edge portion contacts the outer end face of the rear holder when the half cover pivots around the housing. As a result, the rib urges the outer end face of the rear holder downward, and the rear holder is correctly moved into the properly inserted position. Therefore, there is no need to take additional time to correct the improper insertion of the rear holder, and the efficiency of the operation is substantially improved.

What is claimed is:

1. A rear holder cover of an electrical waterproof connector for securing a terminal to a connector housing comprising:

a rear holder in which a wire associated with said terminal is received in an insertion direction;

a plurality of hinge connection portions each having a first end and a second end, wherein said first end of each of said plurality of hinge connection portions is connected to said rear holder, wherein said rear holder is insertable into said connector housing by movement in said insertion direction parallel to a longitudinal axis, and wherein said hinge connection portions are pivotally movable in a direction perpendicular to said insertion direction and about respective axes which are parallel to said longitudinal axis;

a plurality of half covers respectively connected to said second end of each of said plurality of hinge connection portions; and securing means for securing said half covers to each other in a position where said half covering circumscribe at least a portion of said connector housing to thereby fixedly secure said rear holder to said connector housing.

2. The rear holder cover of claim 1, wherein said securing means comprises a projection portion and a projection receiving portion respectively provided in each of said plurality of half covers, wherein said projection portion of each of said plurality of half covers respectively engage said projection receiving portion of each adjacent half cover so as to secure said rear holder cover on said connector housing.

3. The rear holder cover according to claim 1, wherein said projection portion is formed on a first side edge of each of said plurality of half covers and said projection receiving portion is formed on a second side edge of each of said plurality of half covers and wherein said first side edge and said second side edge are opposite side edges of each of said plurality of half covers and said first side edge and said second side edge are parallel to said insertion direction.

4. The rear holder cover according to claim 1, wherein at least one of said plurality of half covers comprises an extension portion which extends from a position where said hinge connection portion is connected to said rear holder and which extends in said insertion direction.

5. The rear holder cover according to claim 1, wherein a rib is formed on an inner surface of at least one of said plurality of half covers and projects in a direction perpendicular to said insertion direction.

6. The rear holder cover according to claim 5, wherein said rib is disposed at an outer end face of said rear holder when said rear holder is properly inserted into said connector housing and said at least one of said plurality of half covers is closed around said connector housing.

7. The rear holder cover according to claim 5, wherein said rib contacts said rear holder when said rear holder is improperly inserted in said connector housing such that said at least one of said plurality of half covers does not properly close around said connector housing.

8. The rear holder cover according to claim 5, wherein said rib comprises a beveled edge portion which contacts said rear holder when said rear holder is improperly inserted in said connector housing and moves said rear holder so as to properly insert said rear holder into said connector housing when said at least one of said plurality of half covers closes around said connector housing.

9. The rear holder cover according to claim 1, further comprising:

at least one fixing hole which is formed in at least one of said plurality of said half covers; and at least one fixing projection which is formed on an outer tube of said connector housing, wherein said at least one fixing projection engages said at least one fixing hole when said at least one of said plurality of half covers is closed around said connector housing in order to further secure said rear holder cover on said connector housing.

10. A rear holder cover of an electrical waterproof connector comprising:

a rear holder;

a plurality of hinge connection portions each having a first end and a second end, wherein said first end of each of said plurality of hinge connection portions is connected to said rear holder, wherein said rear holder is insertable in a connector housing, and wherein said hinge connection portions are pivotally movable in a direction perpendicular to a direction of insertion of said rear holder into said connector housing;

a plurality of half covers respectively connected to said second end of each of said plurality of hinge connection portions, wherein each of said plurality of half covers comprises a projection portion and a projection receiving portion, wherein said projection portion of each of said plurality of half covers engages said projection receiving portion of each adjacent half cover so as to secure said rear holder cover on said connector housing, wherein said projection portion is formed on a first side edge of each of said plurality of half covers and said projection receiving portion is formed on a second side edge of each of said plurality of half covers, wherein said first side edge and said second side edge are opposite side edges of each of said plurality of half covers and said first side edge and said second side edge are parallel to said direction of insertion of said rear cover, and wherein at least a first of said plurality of half covers comprises an extension portion which extends from a position where said hinge connection portion is connected to said rear holder and which extends in said direction of insertion of said rear holder;

a rib which is formed on an inner surface of at least a second of said plurality of half covers and which projects in a direction perpendicular to said direction of insertion of said rear holder;

at least one fixing hole which is formed in at least one of said first and second of said half covers; and at least one fixing projection which is formed on an outer tube of said connector housing, wherein said at least one fixing projection engages said at least one fixing hole when at least said one of said first and second of half covers is closed around said connector housing in order to further secure said rear holder cover on said connector housing.

11. The rear holder cover according to claim 10, wherein said rib is disposed at an outer end face of said rear holder when said rear holder is properly inserted into said connector housing and at least said second of said plurality of half covers is closed around said connector housing.

12. The rear holder cover according to claim 10, wherein said rib contacts said rear holder when said rear holder is improperly inserted in said connector housing such that at least said second of said plurality of half covers does not properly close around said connector housing.

13. The rear holder cover according to claim 10, wherein said rib comprises a beveled edge portion which contacts said rear holder when said rear portion is improperly inserted in said connector housing and moves said rear portion so as to properly insert said rear portion into said connector housing when at least said second of said plurality of half covers closes around said connector housing.

14. The rear holder cover according to claim 10, wherein said first of said plurality of half covers and said second of said plurality of half covers are a same half cover.

15. The rear holder cover according to claim 10, wherein said first of said plurality of half covers and said second of said plurality of half covers are different half covers.

16. The rear holder cover according to claim 13, wherein said first of said plurality of half covers and said second of said plurality of half covers are a same half cover.

* * * * *